US011029069B2

(12) United States Patent
Celik et al.

(10) Patent No.: US 11,029,069 B2
(45) Date of Patent: Jun. 8, 2021

(54) ICE MAKING APPARATUS FOR USE IN A REFRIGERATOR

(71) Applicant: ARCELIK ANONIM SIRKETI, Istanbul (TR)

(72) Inventors: Kadir Ridvan Celik, Istanbul (TR); Ali Gokhan Genc, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 15/511,206

(22) PCT Filed: Sep. 30, 2014

(86) PCT No.: PCT/EP2014/070851
§ 371 (c)(1),
(2) Date: Mar. 14, 2017

(87) PCT Pub. No.: WO2016/050272
PCT Pub. Date: Apr. 7, 2016

(65) Prior Publication Data

US 2017/0276418 A1 Sep. 28, 2017

(51) Int. Cl.
*F25C 5/18* (2018.01)
*F25C 5/185* (2018.01)

(52) U.S. Cl.
CPC ..... *F25C 5/185* (2013.01); *F25C 2305/022* (2013.01); *F25C 2400/06* (2013.01); *F25C 2400/10* (2013.01); *F25D 2400/16* (2013.01)

(58) Field of Classification Search
CPC ..... F25C 5/06; F25C 5/185; F25C 2305/022; F25C 2400/06
See application file for complete search history.

(56) References Cited

U.S. PATENT DOCUMENTS 7,204,092 B2 * 4/2007 Azcarate Castrellon ..... F25C 1/04 249/118

FOREIGN PATENT DOCUMENTS

| | | | |
|---|---|---|---|
| CN | 202747713 | U | 2/2013 |
| KR | 20140075288 | A | 6/2014 |
| WO | 2006011284 | A1 | 2/2006 |
| WO | 2014079703 | A1 | 5/2014 |

OTHER PUBLICATIONS

International search report and written opinion, dated Jun. 22, 2015, of corresponding International Application No. PCT/EP2014/070851; 9 pgs.

* cited by examiner

*Primary Examiner* — Christopher R Zerphey

(74) *Attorney, Agent, or Firm* — Kilpatrick Townsend & Stockton LLP

(57) ABSTRACT

The present invention relates to an ice making apparatus comprising a casing, ice trays, an ice receptacle, a retainer for rotatably supporting the ice trays and one or more than one knob for respectively twisting the ice trays either simultaneously or singly. In the ice making apparatus of the present invention, the retainer selectively supports either one of a plurality of exchangeable covers enabling a single or simultaneous twist type ice making apparatus. One exchangeable cover has a plurality of bearings.

13 Claims, 9 Drawing Sheets

ICE MAKING APPARATUS FOR USE IN A REFRIGERATOR

RELATED APPLICATIONS

Figure 1:
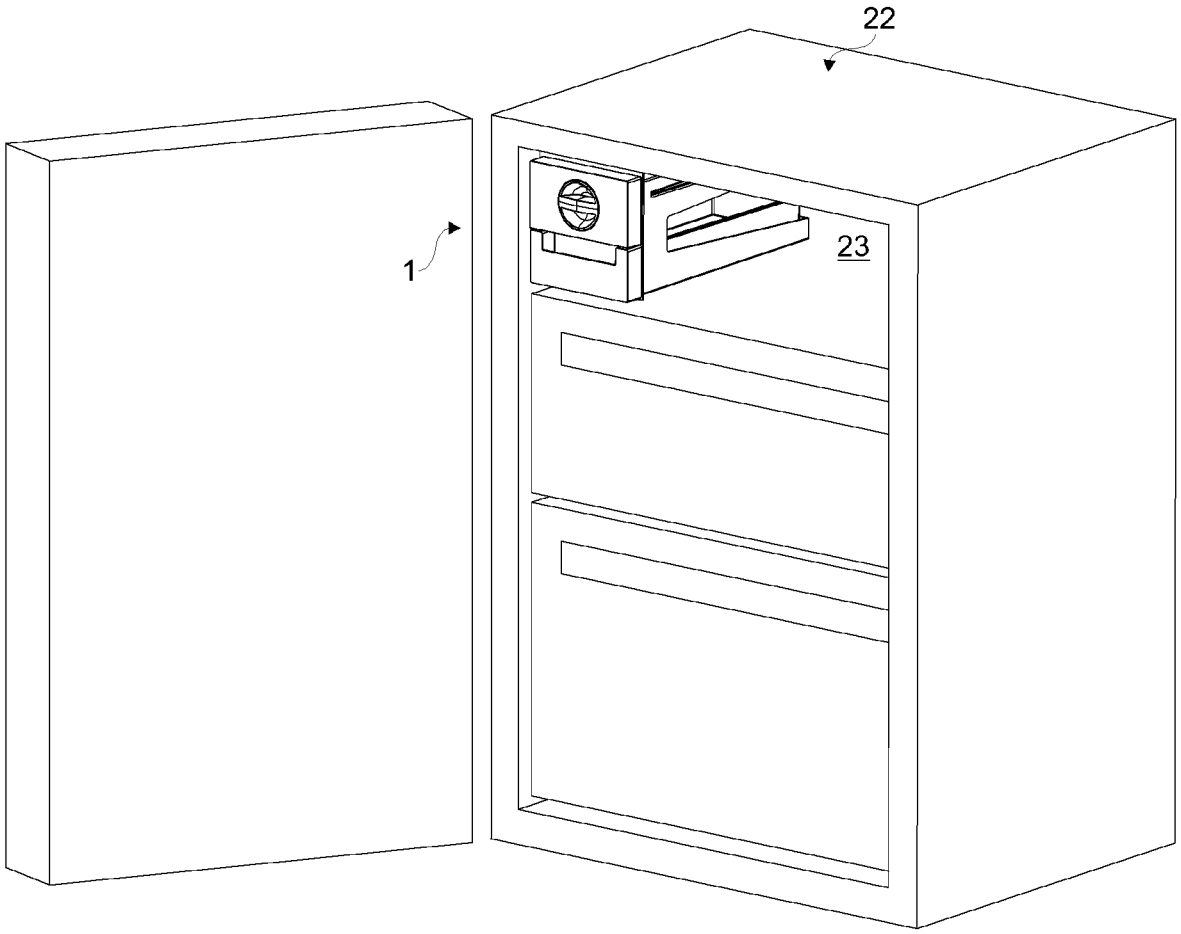

This application is a U.S. National Phase of International Application No. PCT/EP2014/070851, filed Sep. 30, 2014, the entire disclosure of which is incorporated by reference herein.

The present invention relates to an ice making apparatus for use in a refrigeration appliance, in particular a domestic refrigerator which has at least one freezer compartment.

It is customary to provide a domestic refrigerator with an individual ice tray for making ice. The user manually fills the ice tray with water and subsequently places the ice tray in the freezer compartment of the domestic refrigerator. When fresh ice is formed in the ice tray, the user takes the ice tray out of the freezer compartment and subsequently manually twists the ice tray to release the ice cubes from the pockets into a portable container for service. This technique is very laborious and time consuming for the user. To improve the convenience for the user, a domestic refrigerator is usually provided with an in-built ice making apparatus. Such an in-built ice making apparatus generally facilitates the aforementioned ice making process and the ice releasing process.

The prior art ice making apparatuses which can be built into the domestic refrigerators are commonly known. Such an in-built prior art ice making apparatus generally includes one or more than one an ice tray, an ice receptacle for collecting the ice which is released from each ice tray, a retainer for rotatably supporting each ice tray and means for twisting the ice trays.

To meet the different requirements of the customers, the prior art ice making apparatuses come in different types. In a commonly known type, the ice making apparatus includes a plurality of knobs for respectively twisting a plurality of ice trays. In this type of prior art ice making apparatus, each ice tray can be singly twisted by the corresponding knob. In another commonly known type, the ice making apparatus includes a single lever for twisting a plurality of ice trays simultaneously. In this type of prior art ice making apparatus, all the ice trays can be simultaneously twisted by the lever.

The customer may desire to purchase a domestic refrigerator having an ice making apparatus according to the former type or the latter type. Thus, there is a need to easily provide the domestic refrigerator in accordance with the desire of the customer. However equipping the domestic refrigerator with the desired type of ice making apparatus generally incurs additional production costs and assembly costs.

An objective of the present invention is to provide an ice making apparatus and a refrigerator having the same which overcomes the aforementioned drawbacks in a cost effective way and which enables an improved production and assemblage.

This objective has been achieved by the claimed ice making apparatus and the claimed refrigerator. Further achievements have been attained by the subject-matters respectively defined in the dependent claims.

In the ice making apparatus of the present invention, the retainer selectively supports either one of a plurality of exchangeable covers which respectively allow conversion to a desired one of a single twist type and a simultaneous twist type ice making apparatus. For manufacturing a single twist type ice making apparatus, the present invention provides an exchangeable cover which has a plurality of bearings. Each bearing holds one knob for singly twisting the corresponding ice tray. In the ice making apparatus of the present invention, each ice tray has a head and each knob has a hub which can be directly and detachably engaged with the head of the corresponding ice tray. For manufacturing a simultaneous twist type ice making apparatus, the present invention provides another exchangeable cover which has a single bearing and a gear assembly. The single bearing holds one knob for simultaneously twisting all ice trays via the gear assembly which couples the ice trays with the knob. The gear assembly has a driving gear and a plurality of driven gears. The driving gear has a head which directly and detachably engages with the hub of the knob. Each driven gear has a hub which directly and detachably engages with the head of the corresponding ice tray.

In an embodiment, the hub of each knob and each driven gear has one notch. And the head of each ice tray and the driving gear has one tab which matches the respective notch. In a version of this embodiment, each notch has at least one slot. And each tab has at least one claw which matches the respective slot.

In another embodiment, the driving gear and each driven gear have respectively at least one relatively large-sized groove and teeth for enabling mutual alignment. The alignment grooves and the alignment teeth allow aligning the driving gear and the knob correctly relative to the rest position of the ice trays.

In another embodiment, the ice trays are biased to the rest position via spring elements disposed onto the retainer.

In another embodiment, the gear assembly can be detachably mounted to a plurality of corresponding bearings formed onto the retainer.

In another embodiment, the ice receptacle can be slidably released or attached to the casing.

In another embodiment, the retainer can be slidably mounted into the casing.

In another embodiment, each knob is round shaped and has a grip.

In another embodiment, each exchangeable cover can be detachably fitted onto the retainer.

In another embodiment, the ice making apparatus has two ice trays and two knobs for singly twisting the two ice trays. And the exchangeable cover has two corresponding bearings for holding the two knobs respectively.

In another alternative embodiment, the ice making apparatus has two ice trays and a single knob for simultaneously twisting the ice trays. And the exchangeable cover has a single bearing and a gear assembly.

The present invention also provides a refrigerator, in particular a domestic refrigerator which has a freezer compartment which accommodates the ice making apparatus of the present invention.

In another embodiment, the ice making apparatus can be detachably mounted onto the inner lining of the freezer compartment.

With the present invention, particularly by virtue of the plurality of exchangeable covers, the ice making apparatus can be assembled as a single twist type ice making apparatus or a simultaneous twist type ice making apparatus without the need of modifying the design or the other component parts in particular, the knobs, the ice trays, the retainer and the casing. Thereby, the production and assembly costs of the ice making apparatus have been reduced both in labor and material. With the present invention, particularly by virtue of the plurality of the exchangeable covers, the ice making apparatus can also be easily converted from a single twist type ice making apparatus to a simultaneous twist type ice making apparatus or vice versa by a service person. Thus, when assembling or converting the ice making apparatus of the present invention in accordance with the user requirements, the waste of component parts due to lack of customer demand have been eliminated or reduced as much as possible. Thereby, the ice making apparatus of the present invention has also been rendered environment friendly. Thereby, a consumer satisfaction can be increased.

Figure 2:
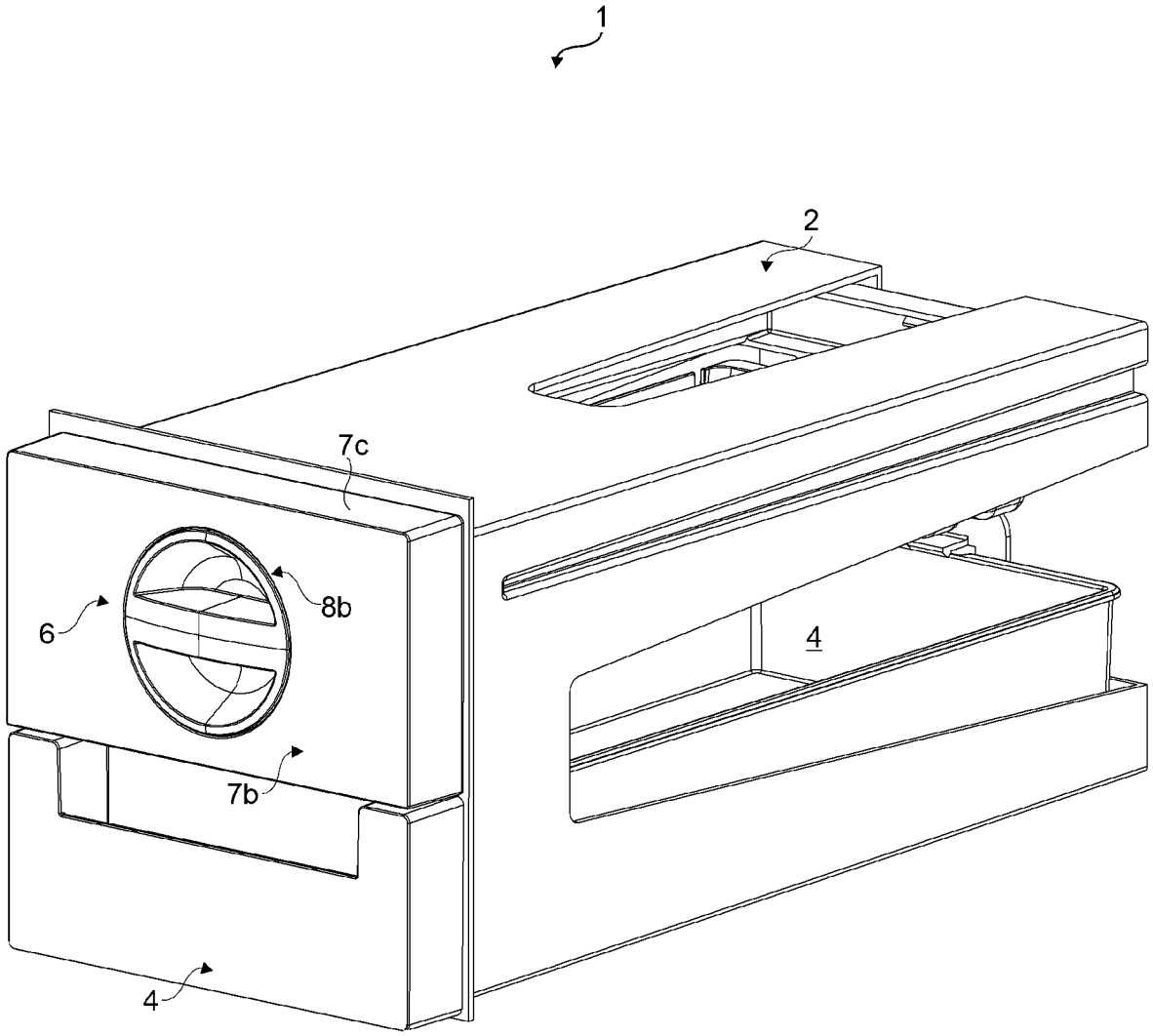
Figure 3:
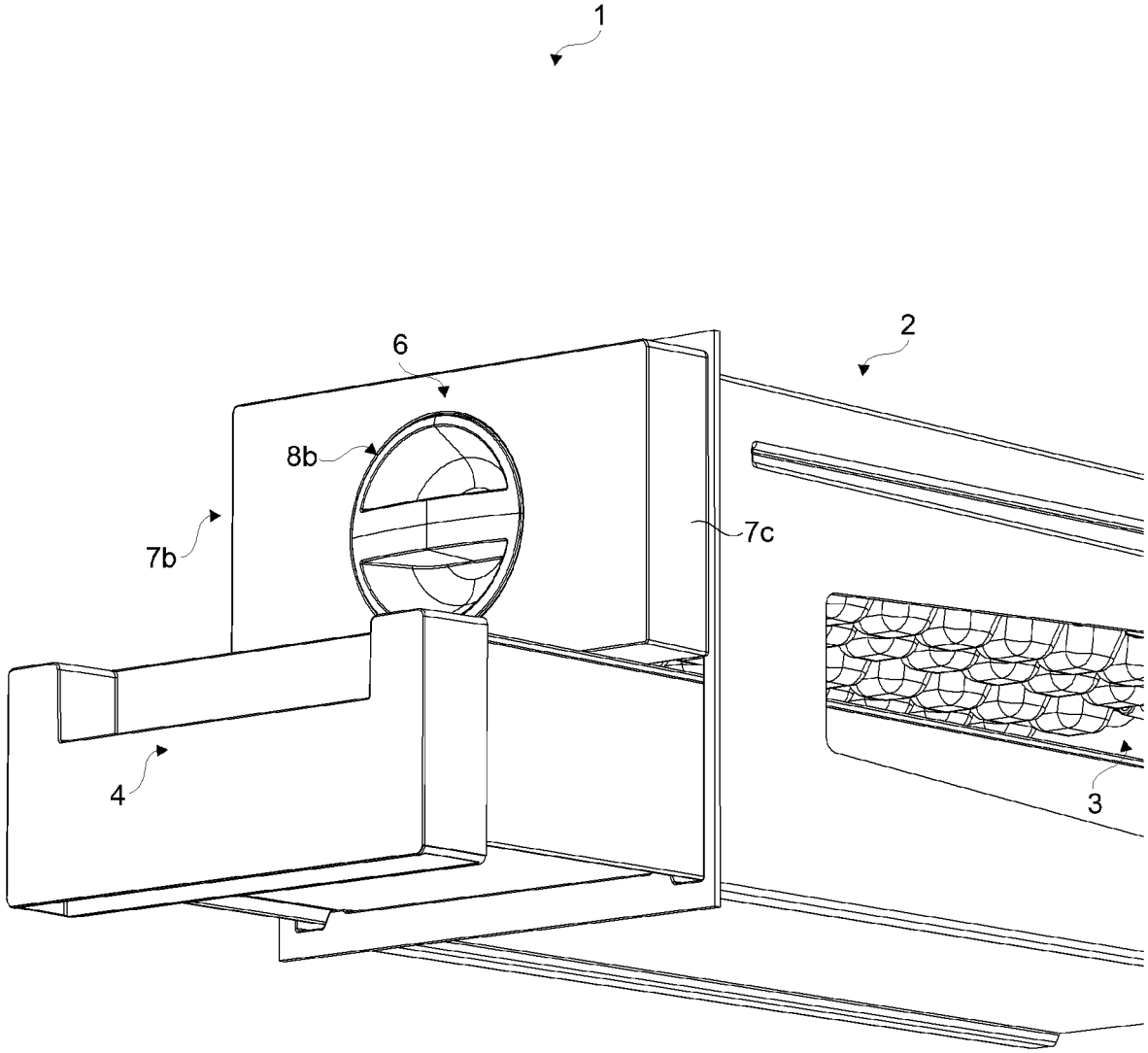
Figure 4:
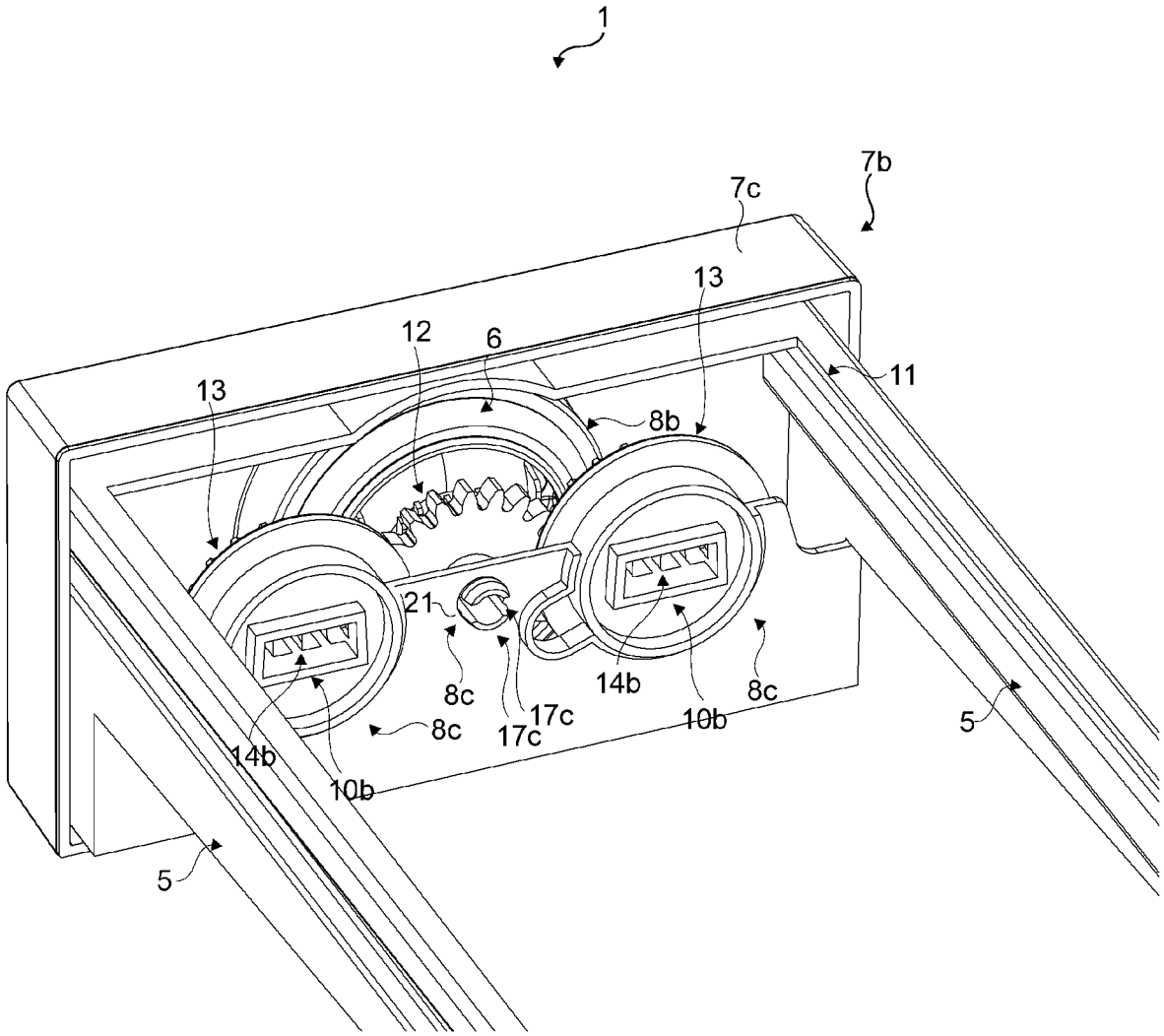
Figure 5:
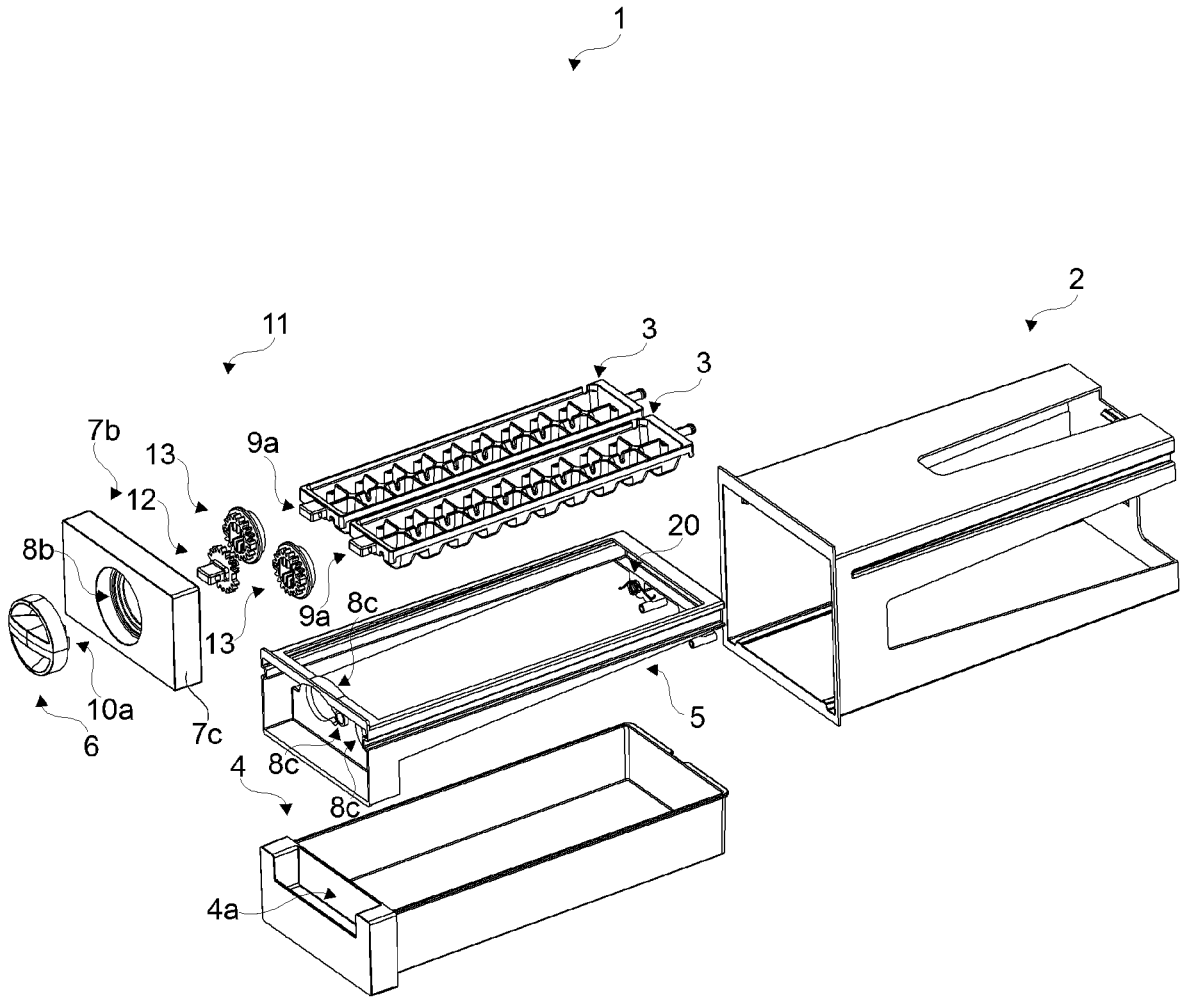
Figure 6:
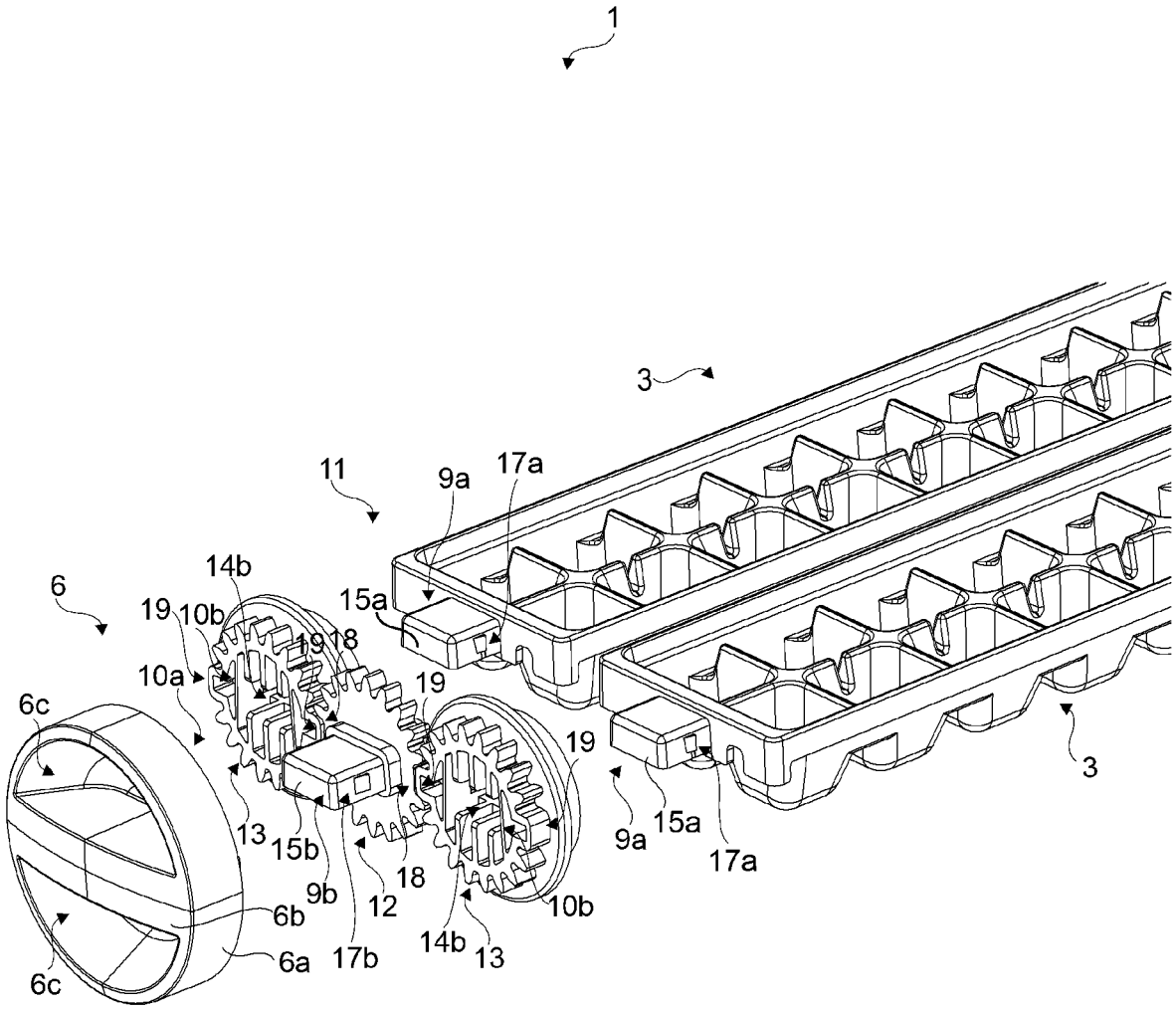
Figure 7:
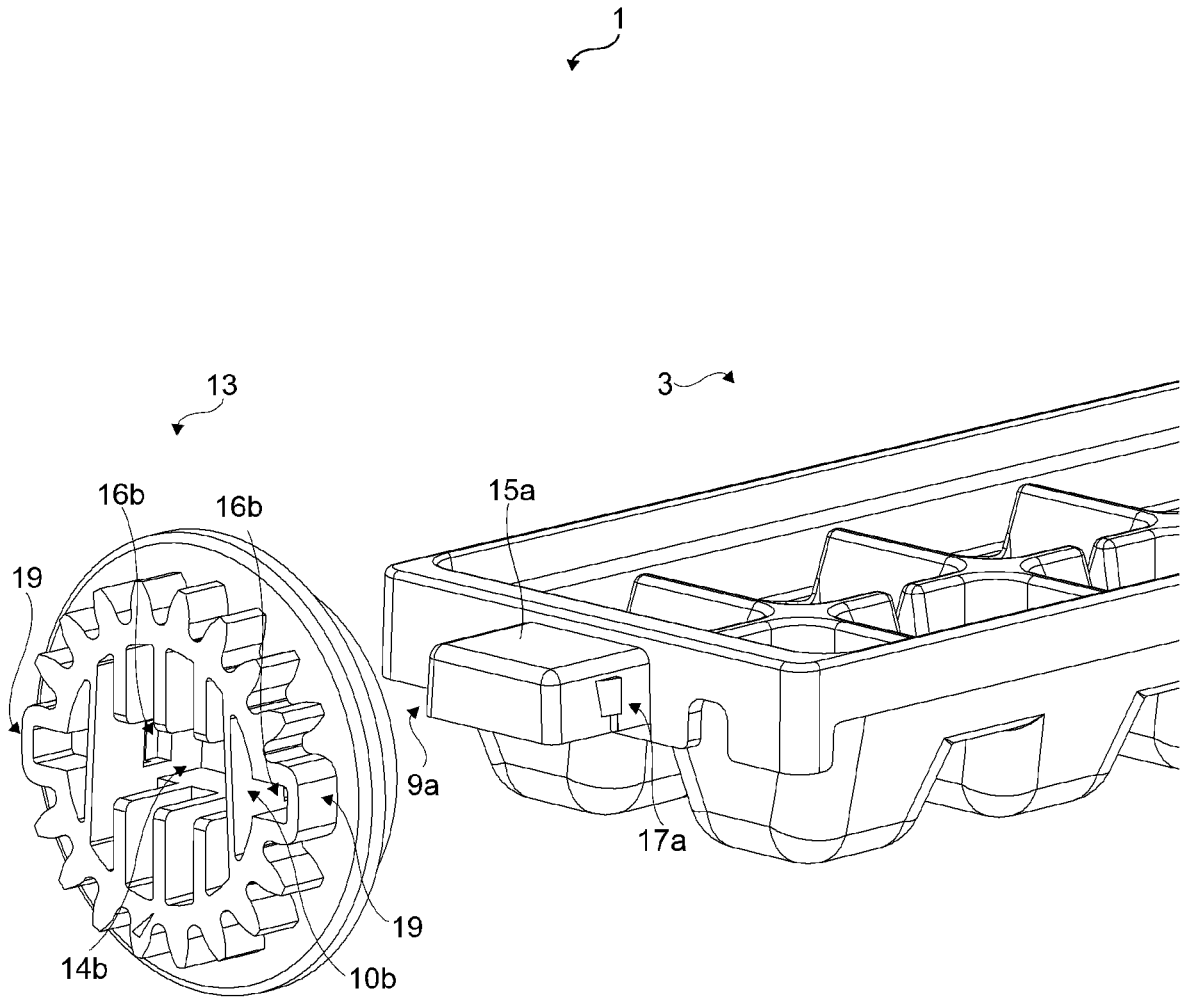
Figure 8:
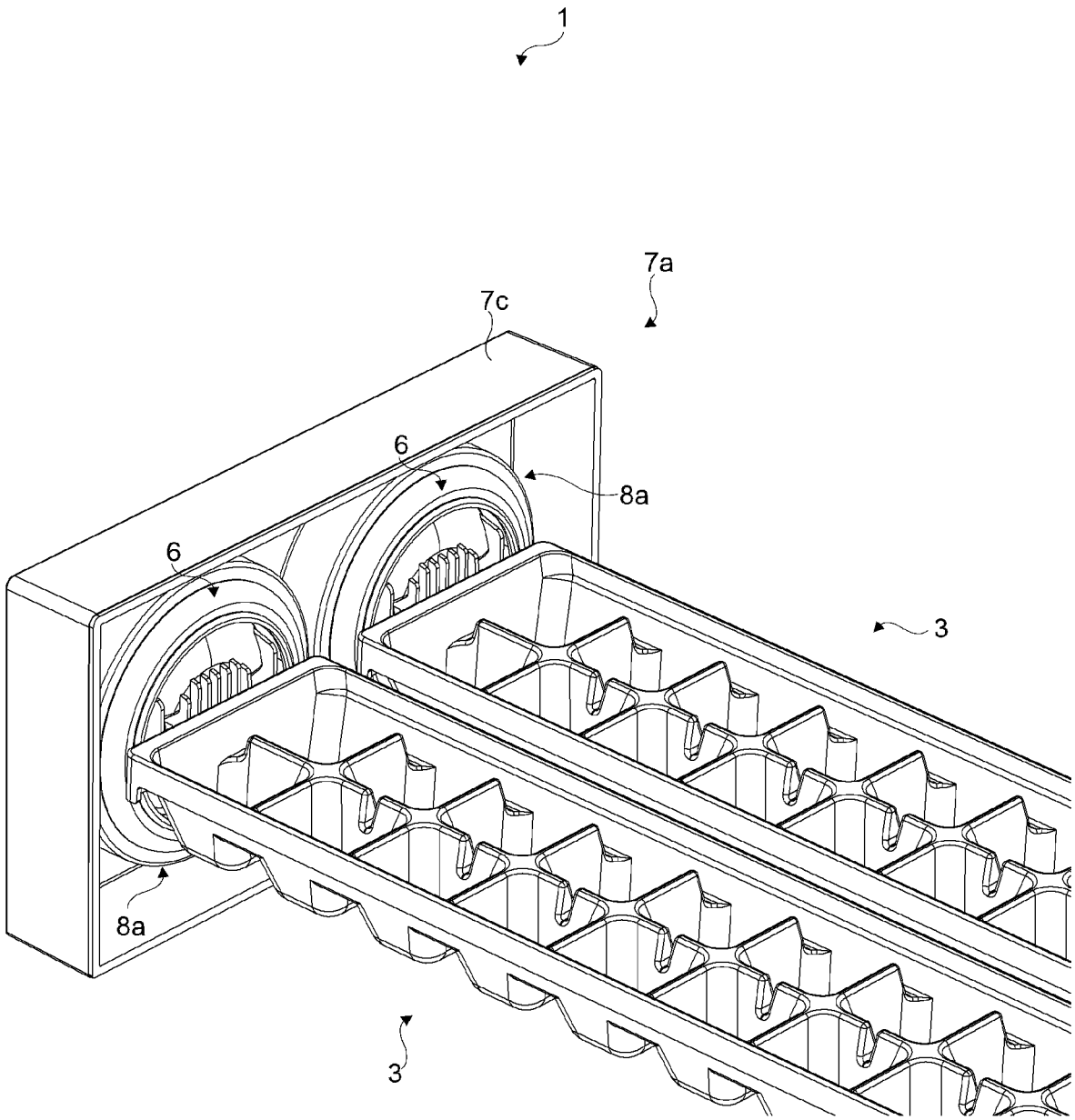
Figure 9:
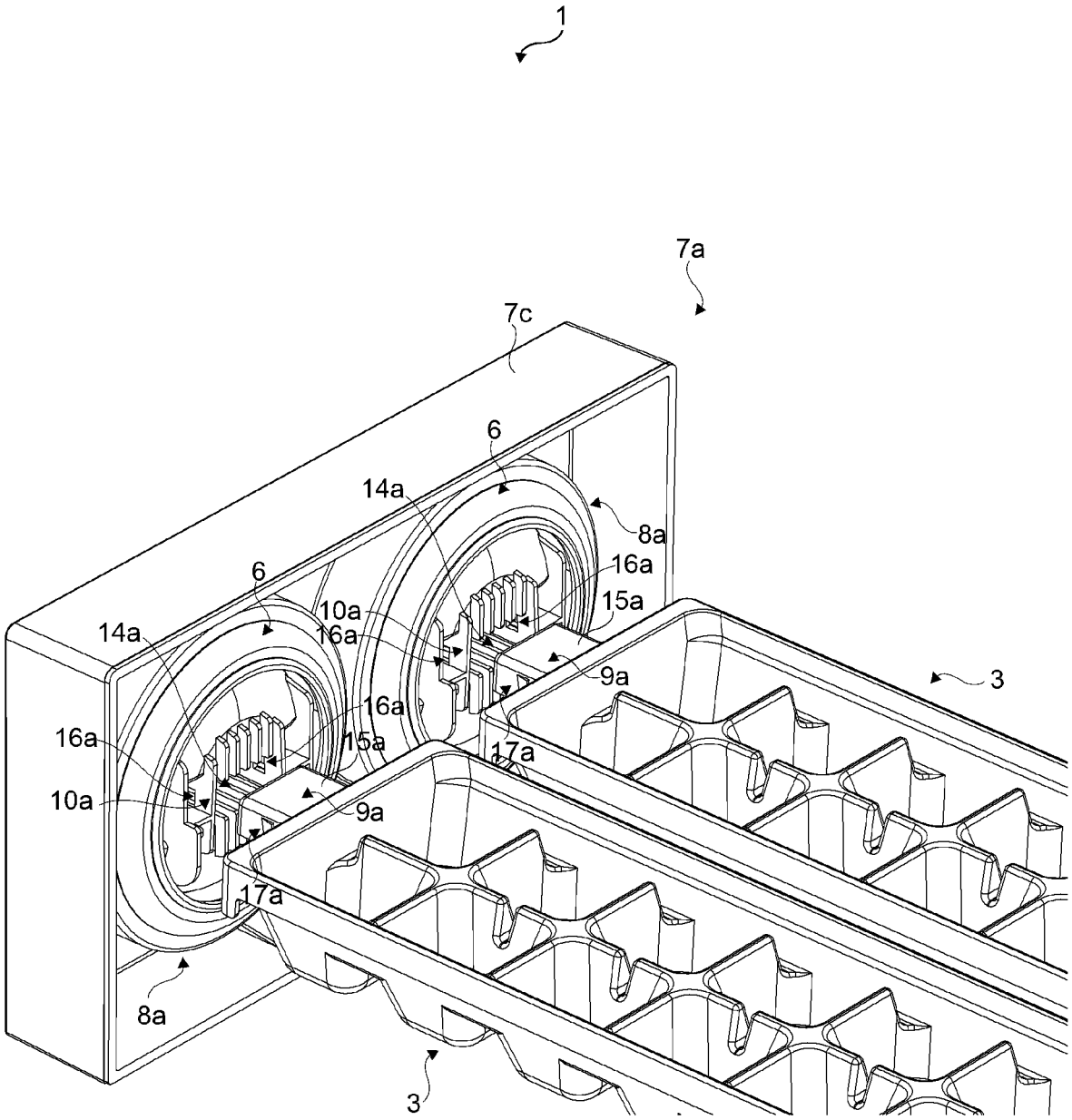

Additional advantages of the ice making apparatus according to the present invention and the refrigerator according to the present invention will become apparent with the detailed description of the embodiments with reference to the accompanying drawings in which:

FIG. 1 is a schematic perspective view of a refrigerator which has an ice making apparatus inside the freezer compartment according to an embodiment of the present invention, FIG. 2 is a schematic perspective view of the ice making apparatus according to an embodiment of the present invention, FIG. 3 is a schematic perspective view of the ice making apparatus according to an embodiment of the present invention, wherein the ice receptacle is partly pulled out, FIG. 4 is a schematic partial inner perspective view of the ice making apparatus according to an embodiment of the present invention, wherein the casing, the ice trays and the ice receptacle have been omitted, FIG. 5 is a schematic perspective exploded view of the ice making apparatus according to an embodiment of the present invention, FIG. 6 is a another schematic partial perspective exploded view of the ice making apparatus according to an embodiment of the present invention, FIG. 7 is a another schematic partial perspective exploded view of the ice making apparatus according to an embodiment of the present invention, FIG. 8 is a schematic partial inner perspective view of the ice making apparatus according to another embodiment of the present invention, wherein the casing, the retainer and the ice receptacle have been omitted, FIG. 9 is a schematic partial inner perspective exploded view of the ice making apparatus according to another embodiment of the present invention, wherein the casing, the retainer and the ice receptacle have been omitted, The reference signs appearing on the drawings relate to the following technical features.

1. Apparatus
2. Casing
3. Tray
4. Receptacle
  4*a*. Grip
5. Retainer
6. Knob
  6*a*. Body
  6*b*. Grip
  6*c*. Recess
7*a*. Cover
7*b*. Cover
7*c*. Frame
8*a*. Bearing
8*b*. Bearing
8*c*. Bearing
9*a*. Head
9*b*. Head
10*a*. Hub
10*b*. Hub
11. Gear assembly
12. Gear
13. Gear
14*a*. Notch
14*b*. Notch
15*a*. Tab
15*b*. Tab
16*a*. Slot
16*b*. Slot
17*a*. Claw
17*b*. Claw
17*c*. Claw
18. Groove
19. Tooth
20. Spring element
21. Rim
22. Refrigerator
23. Compartment The ice making apparatus (1) comprises a casing (2) which accommodates ice trays (3), an ice receptacle (4) disposed below the ice trays (3), a retainer (5) for rotatably supporting the ice trays (3) and one or more than one knob (6) for respectively twisting the ice trays (3) simultaneously or singly (FIGS. 1 to 9).

In the ice making apparatus (1) of the present invention, the retainer (5) selectively supports either one of a plurality of exchangeable covers (7*a*, 7*b*). In the ice making apparatus (1) of the present invention, the casing (2) accommodates either an exchangeable cover (7*a*) which has a plurality of bearings (8*a*), wherein each bearing (8*a*) holds one knob (6) for singly twisting the corresponding ice tray (3) and wherein each ice tray (3) has a head (9*a*) and wherein each knob (6) has a hub (10*a*) which directly and detachably engages with the head (9*a*) of the corresponding ice tray (3), or the casing (2) accommodates another exchangeable cover (7*b*) which has a single bearing (8*b*) and a gear assembly (11), wherein the single bearing (8*b*) holds one knob (6) for simultaneously twisting all ice trays (i) via the gear assembly (11) which couples the ice trays (3) with the knob (6), wherein the gear assembly (11) has a driving gear (12) and a plurality of driven gears (13), wherein the driving gear (12) has a head (9*b*) which directly and detachably engages with the hub (10*a*) of the knob (6) and wherein each driven gear (13) has a hub (10*b*) which directly and detachably engages with the head (9*a*) of the corresponding ice tray (3).

In an embodiment, the hub (10*a*) of each knob (6) comprises a notch (14*a*). And the head (9*a*) of each ice tray (3) has a matching tab (15*a*) which detachably fits into the notch (14*a*) of the corresponding knob (6). In this embodiment, the head (9*b*) of the driving gear (12) has a matching tab (15*b*) which detachably fits into the notch (14*a*) of the knob (6). And the hub (10*b*) of each driven gear (13) has a notch (14*b*) which detachably fits onto the matching tab (15*a*) of the corresponding ice tray (3).

In another embodiment, the notch (14*a*) of each knob (6) has one or more than one slot (16*a*). And the matching tab (15*a*) of each corresponding ice tray (3) has one or more than one matching claw (17*a*) which snap-fits into the respective slot (16*a*) of the corresponding knob (6). In this embodiment, the matching tab (15*b*) of the driving gear (12) has one or more than one matching claw (17*b*) which snap-fits into the respective slot (16*a*) of the knob (6). And the notch (14*b*) of each driven gear (13) has one or more than one slot (16*b*) into which the respective matching claw (17*a*) of the corresponding ice tray (3) snap-fits.

In another embodiment, the driving gear (12) has one or more than one alignment groove (18). And each driven gear (13) has one or more than one alignment tooth (19). The alignment groove (18) and the alignment tooth (19) are relatively larger than the other grooves and the other teeth respectively. Each alignment groove (18) of the driving gear (12) meshes with the respective alignment tooth (19) of the corresponding driven gear (13) when the corresponding ice tray (3) is facing horizontally upwards and the knob (6) is at the rest position.

In another embodiment, the retainer (5) supports spring elements (20) which respectively bias the ice trays (3) to the rest positions where the ice tray (3) is horizontally aligned and faces upwards.

In another embodiment, the retainer (5) comprises bearings (8*c*) which detachably and rotatably support the driving gear (12) and the driven gears (13) respectively.

In another embodiment, the driving gear (12) has arc-shaped claws (17*c*) which snap fittingly engage with the rim (21) of the corresponding bearing (8*c*) on the retainer (2).

In another embodiment, the receptacle (4) is slidably and releasably disposed inside the lower section of the casing (2). In a version of this embodiment, the receptacle (4) has a grip (4*a*) which is formed by a depression.

In another embodiment, the retainer (5) is slidably mountable into the upper section of the casing (2).

In another embodiment, each knob (6) comprises a round shaped body (6*a*) and a grip (6*b*) which is defined by two diametrically opposed recesses (6*c*) formed into the front section of the body (6*a*).

In another embodiment, each exchangeable cover (7*a*, 7*b*) has a frame (7*c*) which detachably fits onto the front section of the retainer (5).

In another embodiment, the casing (2) accommodates two ice trays (3) and two knobs (6) for singly twisting the two ice trays (3). And the exchangeable cover (7*a*) has two bearings (8*a*), wherein each bearing (8*a*) holds one respective knob (6) (FIGS. 8 to 9).

In another alternative embodiment, the casing (2) accommodates two ice trays (3) and one knob (6) for simultaneously twisting the ice trays (3). And the exchangeable cover (7*b*) has a single bearing (8*b*) and a gear assembly (11). The single bearing (8*b*) holds the knob (6). The gear assembly (11) has a driving gear (12) and two driven gears (13). The driven gears (13) are each directly meshed with the driving gear (12) (FIGS. 1 to 7).

The refrigerator (22) comprises a freezer compartment (23). The refrigerator (22) of the present invention comprises the ice making apparatus (1) and in another embodiment, the ice making apparatus (1) is detachably disposed into the freezer compartment (23).

With the present invention, a convertible and environment friendly ice making apparatus (1) has been provided which can be assembled as a single twist type ice making apparatus (1) or a simultaneous twist type ice making apparatus (1). Thereby, the production and assembly costs of the ice making apparatus (1) have been reduced both in labor and material. With the present invention, a consumer satisfaction can be increased.

The invention claimed is:

1. An ice making apparatus comprising a casing accommodating ice trays, an ice receptacle disposed below the ice trays, a retainer for rotatably supporting the ice trays, the retainer including a plurality of bearings for receiving a plurality of driven gears, and one or more than one knob for respectively twisting the ice trays simultaneously or singly, wherein the ice making apparatus has a single twist mode and a simultaneous twist mode, wherein in the single twist mode where each ice tray is twisted independently from remaining ice trays, the retainer is coupled to a first exchangeable cover which has a plurality of bearings, each bearing corresponding to a bearing of the retainer and holding a plurality of knobs, one knob for singly twisting a corresponding ice tray, each ice tray has a head and each knob has a hub which directly and detachably engages with the head of the corresponding ice tray, wherein in the simultaneous twist mode where all ice trays are twisted simultaneously, the retainer is coupled to a second exchangeable cover which has a gear assembly and only one bearing holding only one knob for simultaneously twisting all ice trays via the gear assembly which couples the ice trays with the only one knob of the second exchangeable cover, the gear assembly has a driving gear coupled to the plurality of driven gears, the driving gear has a head which directly and detachably engages with the hub of the only one knob and each driven gear has a hub which directly and detachably engage with the head of the corresponding ice tray wherein the first exchangeable cover and the second exchangeable cover are interchangeable such that the ice making apparatus is convertible between the single twist mode and the simultaneous twist mode by the retainer selectively coupling to the first exchangeable cover and the second exchangeable cover, respectively.

2. The ice making apparatus according to claim 1, wherein the hub of each knob of the first exchangeable cover or the second exchangeable cover comprising a notch and the head of each ice tray has a matching tab which detachably fits into the notch of the corresponding knob, the head of the driving gear of the second exchangeable cover has a matching tab which detachably fits into the notch of the knob, and the hub of each driven gear of the second exchangeable cover has a notch which detachably fits onto the matching tab of the corresponding ice tray.

3. The ice making apparatus according to claim 2, wherein the notch of each knob of the first exchangeable cover or the second exchangeable cover has one or more than one slot and the matching tab of each corresponding ice tray has one or more than one matching claw which snap-fits into the respective slot of the corresponding knob, the matching tab of the driving gear of the second exchangeable cover has one or more than one matching claw which snap-fits into the respective slot of the knob and the notch of each driven gear of the second exchangeable cover has one or more than one slot into which the respective matching claw of the corresponding ice tray snap-fits.

4. The ice making apparatus according to claim 1, wherein the driving gear of the second exchangeable cover has one or more than one alignment groove and each driven gear has one or more than one alignment tooth, wherein each alignment groove meshes with the respective alignment tooth of the corresponding driven gear when the corresponding ice tray is facing horizontally upwards and the knob is at a rest position.

5. The ice making apparatus according to claim 1, wherein the retainer supports spring elements which respectively bias a corresponding ice tray to a rest position where the ice tray is horizontally aligned and faces upwards.

6. The ice making apparatus according to claim 1, wherein the plurality of bearings of the retainer are adapted to detachably and rotatably support the driving gear and the driven gears of the second exchangeable cover respectively.

7. The ice making apparatus according to claim 6, wherein the driving gear of the second exchangeable cover has arc-shaped claws which snap fittingly engage with a rim of the corresponding bearing on the retainer.

8. The ice making apparatus according to claim 1, wherein the ice receptacle is slidably and releasably disposed inside a lower section of the casing.

9. The ice making apparatus according to claim 1, wherein the retainer is slidably mountable into an upper section of the casing.

10. The ice making apparatus according to claim 1, wherein each knob comprising a round shaped body and a grip which is defined by two diametrically opposed recesses formed into a front section of the body.

11. The ice making apparatus according to claim 1, wherein each exchangeable cover has a frame which fits onto a front section of the retainer.

12. A refrigerator comprising a freezer compartment, including an ice making apparatus according to claim 1.

13. The refrigerator according to claim 12, wherein the ice making apparatus is detachably disposed into the freezer compartment.

* * * * *